US005918811A

United States Patent [19]

Denham et al.

[11] Patent Number: 5,918,811

[45] Date of Patent: Jul. 6, 1999

[54] SHOWERHEAD WITH VARIABLE SPRAY PATTERNS AND INTERNAL SHUTOFF VALVE

[75] Inventors: Willard A. Denham, Greenville; Christopher G. Miedzius, Newark, both of Del.

[73] Assignee: Speakman Company, Wilmington, Del.

[21] Appl. No.: 08/874,012

[22] Filed: Jun. 12, 1997

[51] Int. Cl.[6] ..... B05B 15/02

[52] U.S. Cl. ..... 239/123; 239/437; 239/444; 239/581.1; 239/DIG. 1; 251/347

[58] Field of Search ..... 239/391, 393, 239/436, 437, 460, 554, 555, 581.1, 583, DIG. 1, 114, 123, 138, 442, 443, 444, 448, 449; 251/347, 259

[56] References Cited

U.S. PATENT DOCUMENTS

| | | | |
|---|---|---|---|
| 2,968,443 | 1/1961 | Manning | 239/460 |
| 2,998,928 | 9/1961 | Aghnides | 239/431 |
| 3,013,729 | 12/1961 | McLean | 239/109 |
| 3,065,917 | 11/1962 | Fraser | 239/460 |
| 3,083,944 | 4/1963 | Doeden | 251/347 |
| 3,189,284 | 6/1965 | Downey | 239/460 |
| 3,373,942 | 3/1968 | Roman et al. | 239/460 |
| 3,383,051 | 5/1968 | Fiorentino | 239/460 |
| 3,540,695 | 11/1970 | Taylor | 251/259 |
| 3,563,469 | 2/1971 | Stacey | 239/383 |
| 4,117,979 | 10/1978 | Lagarelli et al. | 239/381 |
| 4,703,893 | 11/1987 | Gruber | 239/391 |

*Primary Examiner*—Andres Kashnikow
*Assistant Examiner*—Lisa Ann Douglas
*Attorney, Agent, or Firm*—Connolly & Hutz

[57] ABSTRACT

A water discharge device in the form of a showerhead is disclosed having multiple features including a rotating shut-off valve incorporated in the body of the device. Variable discharge patterns are achieved by rotation of a handle on the side of the device. These patterns include a vibrating spray, a columnar spray pattern and cone shaped spray pattern. All patterns are achieved at low flow rates.

24 Claims, 5 Drawing Sheets

SHOWERHEAD WITH VARIABLE SPRAY PATTERNS AND INTERNAL SHUTOFF VALVE

BACKGROUND OF THE INVENTION

Applicant's assignee, Speakman Company, is a pioneer in the field of adjustable spray pattern showerheads. These are sold under the ANYSTREAM trademark throughout the world. Numerous patents have been obtained by Speakman describing details of such showerheads. These include: McLean U.S. Pat. No. 3,013,729; Fraser U.S. Pat. No. 3,065,917; Roman et al U.S. Pat. No. 3,373,942; Fiorentino U.S. Pat. No. 3,383,051; and Lagarelli U.S. Pat. No. 4,117,979. Another type of adjustable spray showerhead is illustrated in Stacey U.S. Pat. No. 3,563,469.

One of the problems encountered with these prior art showerheads is loss of spray pattern integrity at low flow conditions currently mandated by state law as a water conservation measure. A national standard (ANSI-ASME A112.8.1 M-1994) has recently been adopted pursuant to the Energy Policy and Conservation Act of 1992 that limits flow through showerheads to 2.5 gallons per minute. A comparable standard has been adopted in Canada (CAN/CSA-B125-M89). Under low flow and low pressure conditions, the spray pattern in some of the prior art showerheads tends not to fill all of the grooves in the plungers of the showerheads described above. This causes erratic and uneven spray patterns. Most showerhead users want, and expect, a uniform spray of even intensity under all flow conditions.

Another problem with some of the showerheads described above is clogging of the grooves in the plungers. This clogging is aggravated where a hard (mineral laden) water supply is used. The buildup of mineral deposits can get so bad that the plungers actually "freeze" in position, thereby disabling, or limiting, the spray adjustment feature of the showerhead. Various approaches to resolution of this problem have been proposed, including use of specific materials or some form of wiping action across openings in the faceplate of a showerhead.

Another aspect of water conservation is the water lost during the non-rinse cycles of a showering experience. A shower spray is usually not wanted during the soap-up or hair shampooing part of the total showering cycle. Water flow during those portions of the shower is essentially wasted. Thus, there is a need for a showerhead that can reduce, or shutoff, water flow when not wanted, without affecting the spray patterns when showering is resumed. Although shutoffs are available, they are typically located upstream of the showerhead in the water supply piping. As such, they are hard to locate and operate by a typical user who may have his or her eyes shut to avoid the sting of soap or shampoo. Those shutoffs that are located on or in the showerhead are typically linked to the showerspray mechanism so that the spray pattern must be readjusted after each water shutoff.

Another disadvantage of existing showerheads is that most grooves used to create a spray pattern are uniform in cross section at any given plane taken through the showerhead. In other words, although the grooves may vary in depth as measured along the axis of the showerhead, few showerhead designers have paid attention to varying the placement of grooves and groove depth around the periphery of the showerhead opening to avoid overlap in spray patterns.

Numerous attempts have been made to provide a vibratory spray in showerheads and other water discharge devices. Most devices used to create a vibratory spray utilize moving parts such as a turbine or off center wobble-plate to achieve the desired periodicity in the water spray. These parts are subjected to considerable wear and often cease to function when mineral deposits interfere with their freedom of movement.

Many showerheads are designed with one, maybe two, of the features discussed above: variable spray patterns, shutoff valve, vibratory spray, controlled spray pattern, self cleaning spray openings. Few have all of these features and none are designed to permit production of showerheads with a variable assortment of such features.

SUMMARY OF THE INVENTION

Applicants have addressed these deficiencies in the showerhead of this invention. More particularly, applicants have created a water discharge device usable as a showerhead, which provides a controlled, coherent spray pattern at very low flow. The individual spray streams emitted by applicants' water discharge device do not intersect in the region near the discharge end of the device due to the carefully controlled orientation of the spray patterns (see FIGS. 2 and 5). This gives a very crisp feel to the spray streams because they are not distorted by bouncing off each other. This exhilarates the bather and enhances the rinsing action of applicants' showerhead.

Applicants' device also provides for a large variation in the intensity and spread of the spray pattern by carefully controlling the geometry of the individual groves surrounding discharge openings in the showerhead faceplate (see FIGS. 6A–6F). An adjustable plunger can be moved longitudinally along those groves to adjust the flow volume and angular spread of the spray pattern emitted from the showerhead (see FIGS. 7–8). Adjustable skirts on the plungers wipe a portion of the grooves to reduce clogging of the grooves and openings with mineral deposits (FIGS. 1 and 3).

Applicants' water discharge device also contains a unique configuration of stationary plates at the center of the showerhead faceplate that discharge a vibratory spray pattern (FIGS. 9–10). A simple twist of the handle on the side of the showerhead allows an instant change from a vibratory spray to regular spray pattern or vice-versa.

A unique cam operated valve integrated into the body of the showerhead permits infinite adjustment of water flow between full-on to full-off. A ring-like portion of the showerhead body's surface is linked to an internal cam surface that translates rotational movement to lateral movement of a shuttle valve that modulates, or shuts off, water flow through the showerhead (FIGS. 9–17).

Applicants' device is completely modular in design so that the features noted above can be mixed and matched as the market dictates. A "barebones" version of the showerhead may only have the adjustable spray feature without the shutoff valve or vibratory spray. Conversely, all of the above features can be included in the same shell as the "barebones" model.

DETAILED DESCRIPTION OF INVENTION

Figure 1:
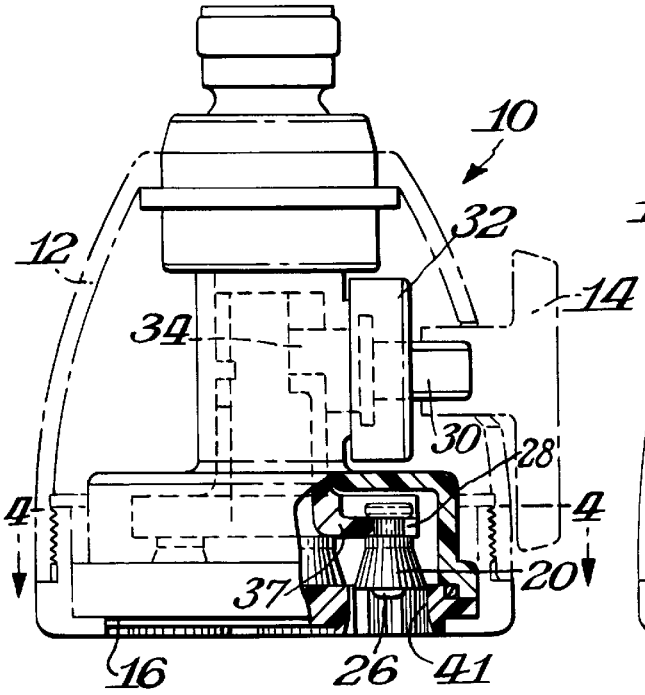
FIG. 1 is an outline in phantom of one embodiment of the showerhead of this invention with a partial breakaway cross section of the plungers seated in faceplate opening.
Figure 3:
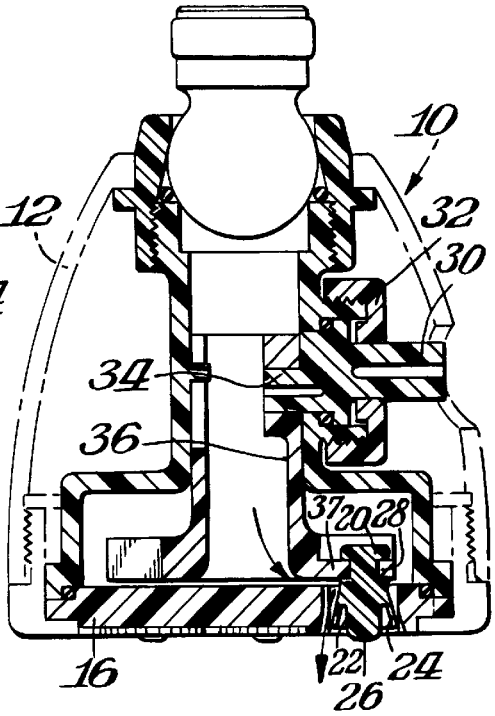
FIG. 3 is a vertical cross-sectional view of one embodiment of the showerhead of this invention illustrating the mechanism used to raise and lower the skirted plungers within the grooved openings in the faceplate.

One embodiment of applicants' showerhead 10 illustrated in FIGS. 1–8 contains a bell shaped outer housing 12 with a rotating handle 14 on the side used to vertically move a set of skirted plungers 20 within openings 40 of a faceplate 16. FIGS. 1–8 illustrate the simplest configuration of that showerhead utilizing adjustable skirted plungers 20 coacting with uniquely configured grooves 42, 44 about the periphery of openings 40 in faceplate 16. In this embodiment neither a vibratory spray nor shutoff valve is used.

Figure 2:
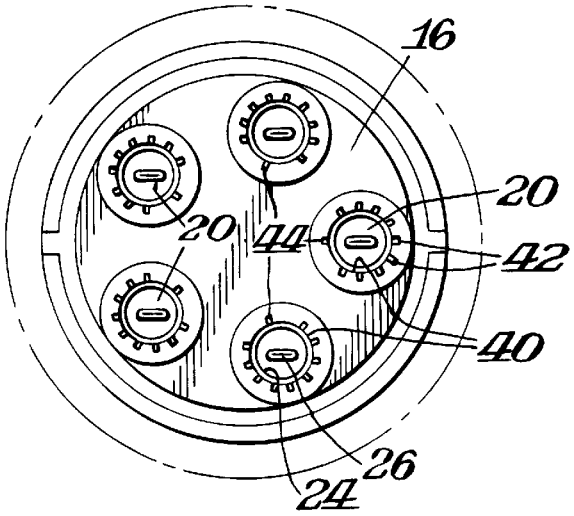
FIG. 2 is a bottom plan view of one embodiment of the showerhead of this invention illustrating the orientation and placement of grooves in the opening of the faceplate.
Figure 5:
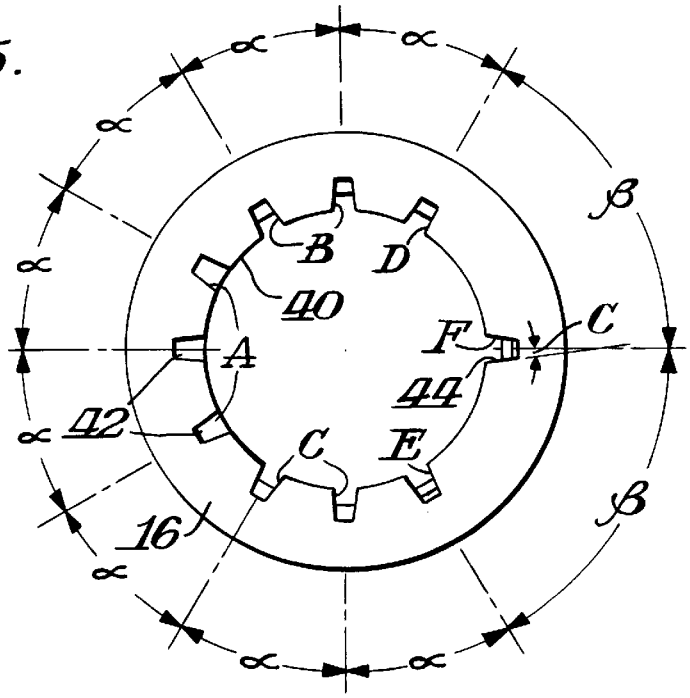
FIG. 5 is a diagrammatic view of the placement of grooves around the periphery of the faceplate openings.

As shown in FIGS. 2 and 5 the grooves 42, 44 are not uniformly spaced about the periphery of openings 40. Grooves 42 are spaced at about 30° radians around approximately one-half of the periphery. The other half of the periphery, which faces the geometric center of the faceplate (See FIGS. 2, 5), contains fewer grooves, and preferably a relatively isolated groove 44 oriented toward the center of the faceplate 16.

Vertically slidable within the openings 40 of faceplate 16 are the skirted plungers 20. The plungers 20 wipe the surface 41 of the openings 40 of the faceplate 16 when the plungers move within the openings 40. This wiping action also acts to dislodge any mineral buildup on the inner surface of grooves 42, 44. The vertical wiping movement of the plunger 20 is accomplished by the pressure exerted by the lower portion of the annular skirt 24 arranged around the lower end 22 of plunger 20. In one embodiment of the invention the outer diameter of skirt 24 is approximately ten thousands of an inch (25 millimeters) larger than the diameter of openings 40. Since the lower end of skirt 24 is thinner at this point, it slightly flexes to accommodate the dimensional difference while maintaining an outward pressure against openings 40 to effectuate the desired wiping action. This wiping helps to keep the openings 40 and grooves 42 and 44 relatively clear of deposits. To further enhance this wiping action each of the plungers 20 may contain a small tab 26 on the bottom thereof which can be used to rotate the plungers 20 within the openings 40 of faceplate 16 see FIG. 1. This combination of vertical and rotational movement of plungers 20 greatly facilitates removal of mineral deposits in the openings 40 and grooves 42, 44 of applicants' showerhead.

Figure 4:
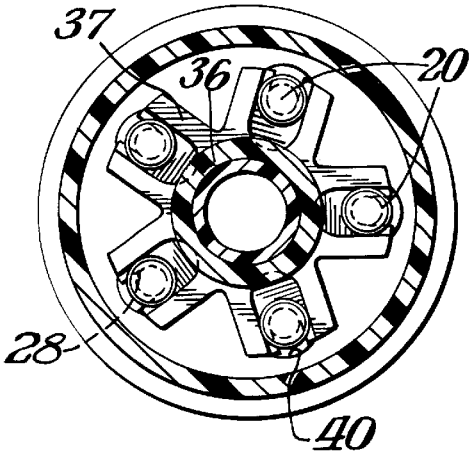
FIG. 4 is a horizontal cross-sectional view of the showerhead along lines 4—4 of FIG. 1.

Vertical movement of plungers 20 is achieved by rotational movement of handle 14 on the side of showerhead 10. The mechanical linkage translating rotational movement of handle 14 into vertical movement of plunger 20 in the embodiment illustrated in FIGS. 1–4 is similar to that disclosed and explained in McLean U.S. Pat. No. 3,013,729, the description of which is incorporated herein by reference. More particularly, the handle 14 has a shaft 30 extending into the interior of showerhead 10 and held in place by a packing nut 32 sealingly attached to the internal structure forming the fluid path through showerhead 10. On its internal end shaft 30 contains an off-center pin 34. This pin 34 is received in a slot in the side of tubular sleeve 36 which, at its lower (discharge) end flares out to form a fork-like prong 37 that fits into mating recesses 28 in plungers 20 (FIG. 4). With this combination, a small rotation of handle 14 is translated into vertical movement of plungers 20. An alternative, keyhole slot configuration for connecting plungers to tubular sleeve 36 is illustrated in FIG. 4.

Figure 6A:
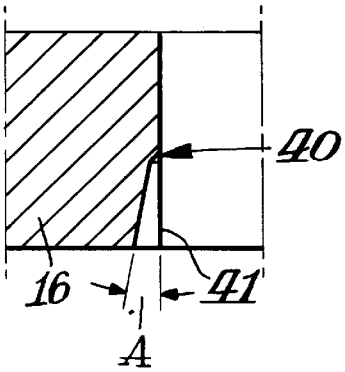
FIGS. 6A–F are partial vertical cross-sections of the grooves.
Figure 6B:
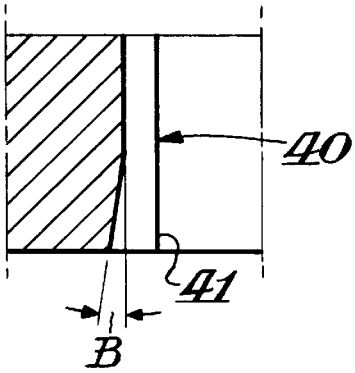
Figure 6C:
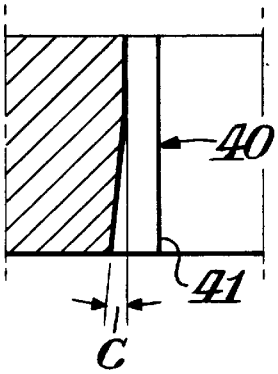
Figure 6D:
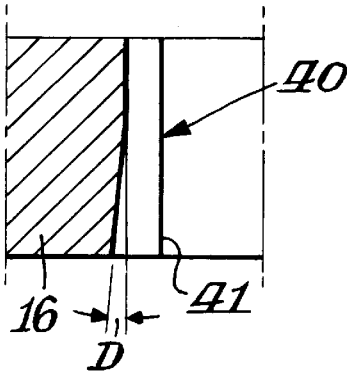
Figure 6E:
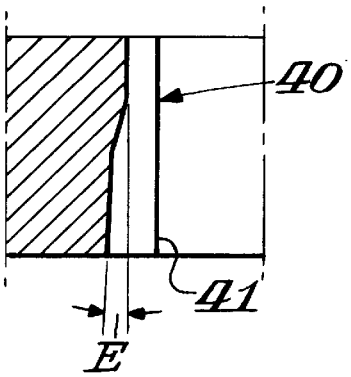
Figure 6F:
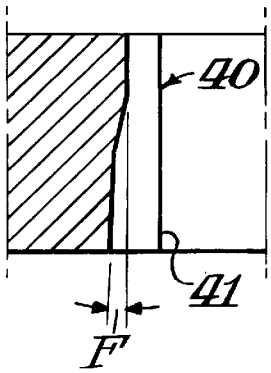
Figure 7:
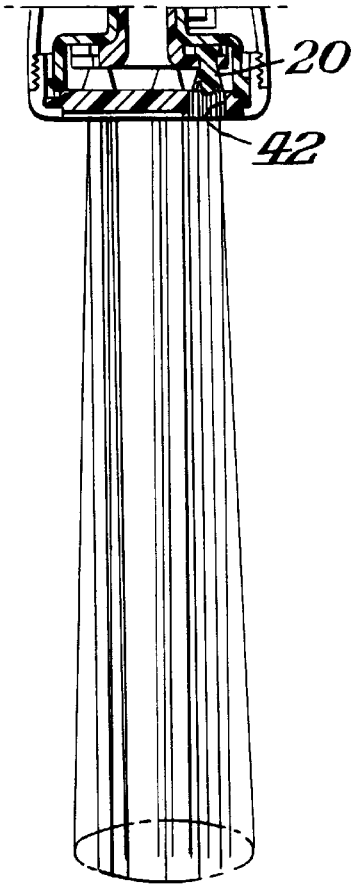
FIG. 7 is a diagrammatic view of one shower spray pattern achieved by applicant's invention.
Figure 8:
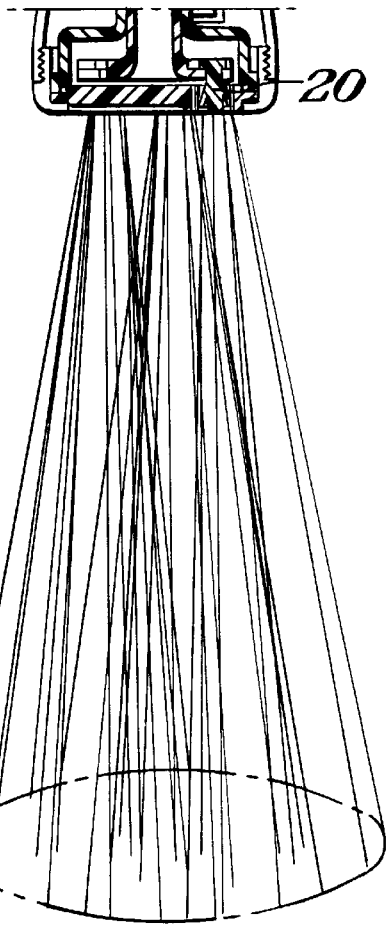
FIG. 8 is diagrammatic view of another spray pattern achieved by applicant's invention.
Figure 17:
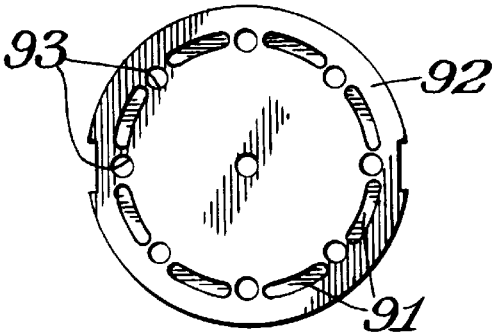
FIG. 17 is a top plan view of the upper plate in the vibratory spray device.
Figure 9:
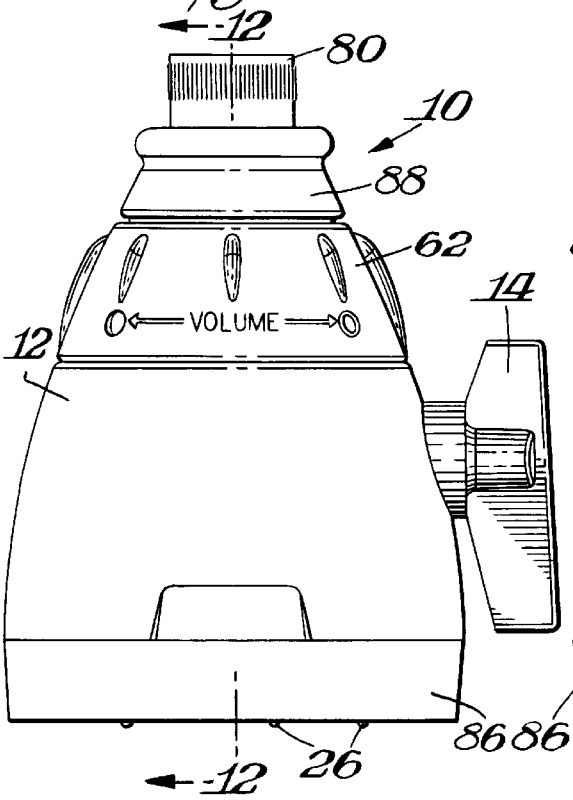
FIG. 9 is a front elevational view of an alternate showerhead embodiment illustrating the external features of the rotating shutoff mechanism.
Figure 10:
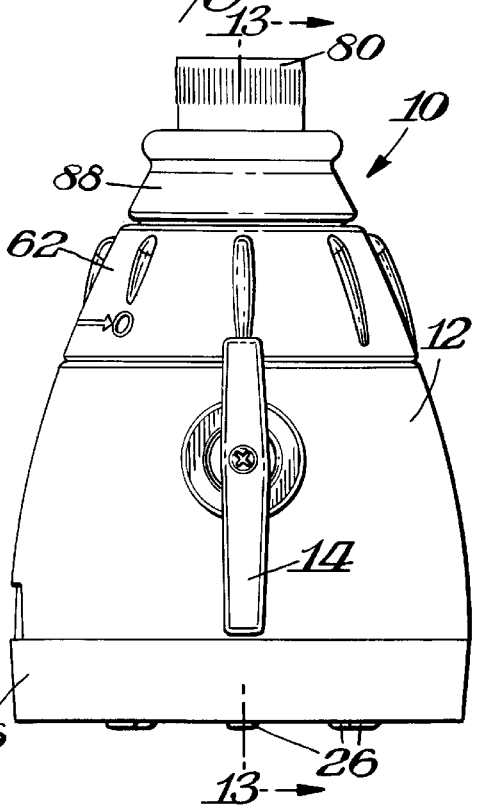
FIG. 10 is a right side elevational view of FIG. 9.
Figure 11:
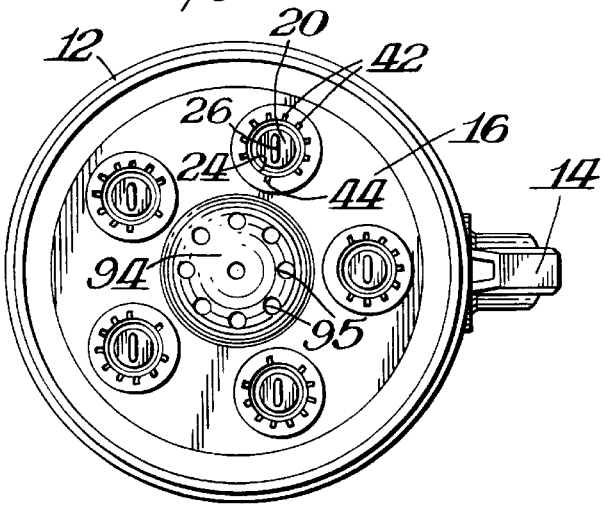
FIG. 11 is a bottom plan view of FIGS. 9 and 10.
Figure 16:
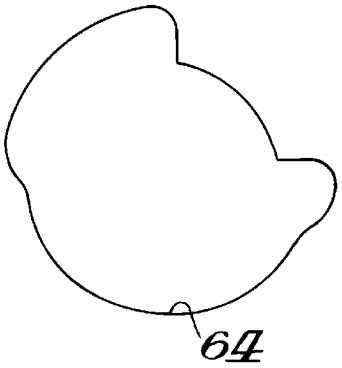
FIG. 16 is a pattern outline of the cam surface used to control the shuttle valve.

As illustrated in FIG. 5 and 6A–F, the configuration of each groove 42, 44 varies. Each of the grooves 42 labeled "A" in FIG. 5 has a groove cross-section as illustrated in FIG. 6A, i.e., a short angled groove with outward taper 48 that only extends about a third of the way up the groove. Each of the other grooves 42 labeled as "B" to "E" in FIG. 5 has a different configuration as more fully described below and FIGS. 6B to 6E, with the relatively isolated groove "F" having a unique configuration of its own. This configuration and orientation of grooves 42, 44 permits gradual adjustment of the spray pattern as plunger 20 is moved within opening 40. When the skirt 24 of plunger 20 is at the top of grooves 42, 44 the pattern is essentially columnar (FIG. 7). As the plunger 20 moves down the grooves 42 the spray pattern forms a cone (FIG. 8). Because the grooves 42 labeled "A" in FIG. 5 do not extend the whole height of the opening 40 in faceplate 16, no water passes through these "A" grooves when the skirt 24 of plunger 20 is at the top of the groove. Only when skirt 24 of plunger 20 is lowered to a position near the bottom of the opening 40 does water start to flow through the "A" grooves. This selective passage of water through only seven grooves (B–F) when the plunger skirt 24 is raised creates the columnar shower stream illustrated in FIG. 7. When plunger skirt 24 is lowered, water passes through ten of the grooves (A–F). Grooves "A" are located in openings 40 as shown in FIGS. 2 and 5. They are oriented away from the center of faceplate 16 and are angled outward to a greater degree than grooves B–F which contributes to the cone-shaped spray pattern shown in FIG. 8. Typical angles from vertical of the grooves are as follow: A-11°; B-9°; C-6°; D-4°; E-2° and F-1°.

The configuration and positioning of grooves 42, 44 in the faceplate, coupled with the flexible skirting 24 on plungers 20, produces a full shower spray even under low flow conditions. More particularly when the three "A" grooves are shutoff as just described, water is forced through seven instead of ten grooves which helps to create a powerful spray pattern.

The positioning of grooves 42, 44 about the periphery of opening 40, as shown in FIG. 5, maximizes the coherency of the spray pattern. More specifically, groove "F" in each opening is oriented toward the geometric center of faceplate 16 as shown in FIG. 2. The adjacent grooves "D" and "E" are spaced an approximately equal angular distance from groove "F" represented by angle β shown in FIG. 5. This angle β is greater than the angle α between the remaining grooves "A", "B" and "C". This radial positioning of grooves around the periphery of opening 40 creates a spray pattern with minimal overlap of individual spray streams emanating from the showerhead. More specifically, this positioning reduces the number of individual streams intersecting in the middle of the spray pattern. Thereby each spray stream retains its own shape for a longer distance before colliding with another spray stream flowing from other openings 40. This results in a better visual appearance of the spray which feels better to the user and promotes better cleansing.

Figure 12:
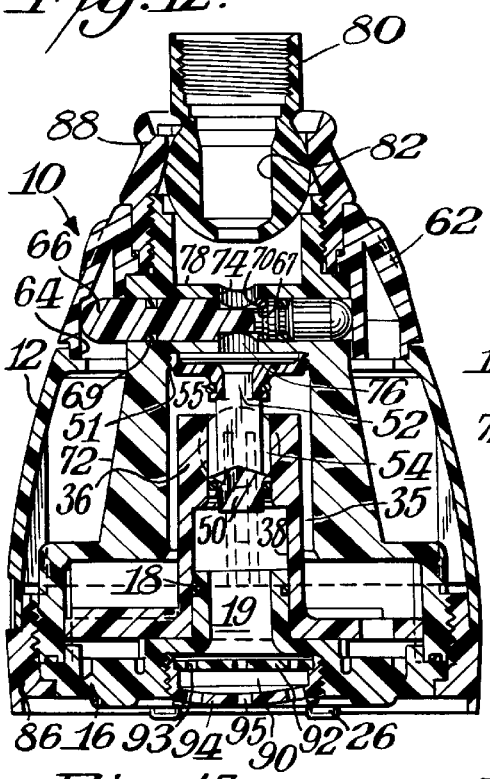
FIG. 12 is a vertical cross-sectional side elevational view taken along line 12—12 of FIG. 9 showing the shuttle valve used to control water flow through the showerhead.
Figure 13:
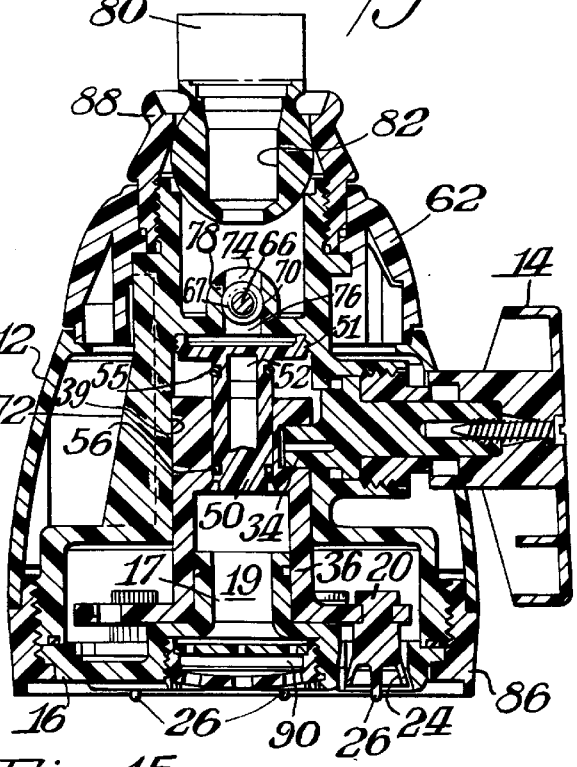
FIG. 13 is a vertical cross-sectional front elevational view taken along line 13—13 of FIG. 10 showing the showerhead containing a rotating shutoff mechanism and vibratory spray device.
Figure 14:
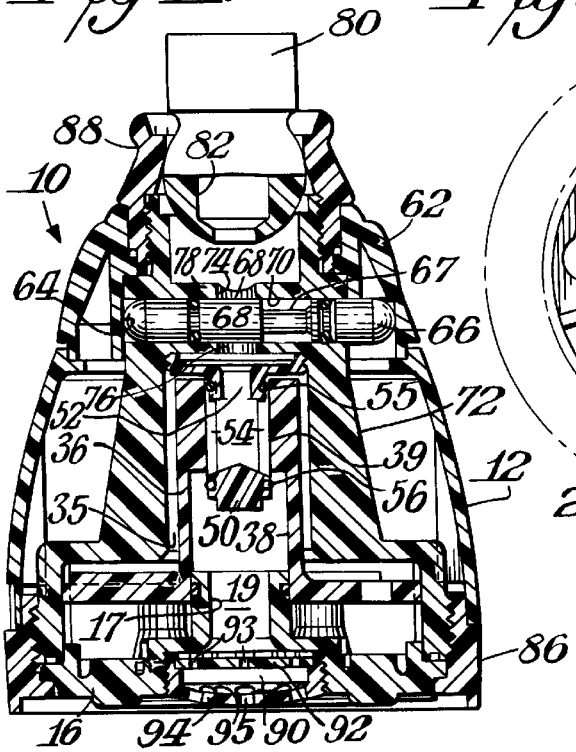
FIG. 14 is a cross-sectional view similar to FIG. 12 showing the plunger holder in a retracted position.
Figure 15:
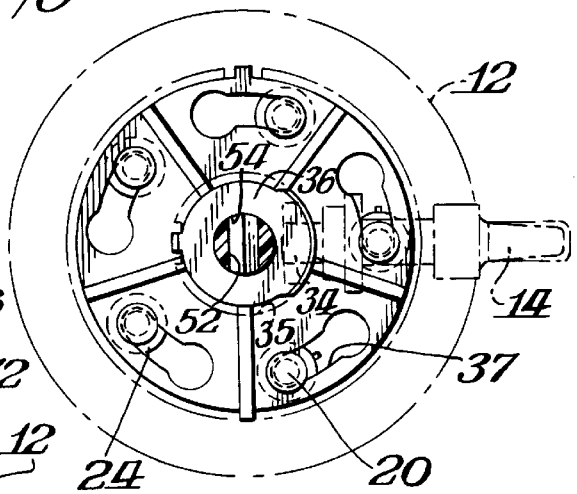
FIG. 15 is a top plan view of the plunger holder of the alternative embodiment and showing the water diverter and selected parts in phantom.

To facilitate soap-up, shampooing and water conservation, one embodiment of this invention contains the shutoff valve illustrated in FIGS. 9–16. More specifically, in this embodiment the upper portion 62 of the showerhead housing 12 is rotatable relative to the balance of housing 12. Captured within this rotatable portion 62 of the housing is a cam surface 64 which causes a shuttle valve 66 shaped like a bobbin to move laterally within a fixed bore 70 in the interior showerhead support structure 72 (FIGS. 12–14). Rotation of the housing 62 causes the cam 64 to rotate, which in turn moves the shuttle valve 66 across the face of water inlet port 74. One portion 67 of the shuttle valve 66 is cutaway to facilitate passage of water from the water inlet port 74 above the shuttle valve 66 to the water outlet port 76 on the underside of the shuttle valve. Another portion 68 of the shuttle valve 66 will block passage of water through ports 74 and 76 (see FIG. 14).

Operation of the shuttle valve 66 is extremely simple, yet effective. Water enters the showerhead body 10 through a standard ball joint 80 having a passage 82 there through. The entering water is then in communication with the water inlet 74 formed in an otherwise water impervious cross member 78 formed within the interior showerhead housing 72. This cross member is thick enough to accommodate the thickness of shuttle valve 66 and water inlet and outlet ports 74 and 76. It is part of the overall interior showerhead housing 72 which extends from the ball joint 80 to faceplate 16. The exterior body 12 surrounds housing 72 and faceplate 16 and is held in place by lower bushing 86 as illustrated in FIGS. 12–14. The upper end of interior housing 72 is sealingly engaged with ball joint 80 by upper bushing 88. The rotatable portion 62 of the showerhead body 12 fits over interior housing 72 and is held in place by upper bushing 88.

Returning to the operation of the shuttle valve 66, water entering ball joint 80 through passage 82 enters inlet port 74. If the cutaway portion 67 shuttle valve 66 is in a lateral position where it is in communication with inlet port 74 and outlet port 76, water will flow there through toward the faceplate 16 through the interior of housing 72 (see FIG. 12). A slight (less than 90°) rotation of upper housing 62 will cause the shuttle valve 66 to laterally move so that the cutaway portion 67 of shuttle valve 66 no longer registers with inlet port 74 pd outlet port 76 thereby cutting off flow through the interior housing 72 (see FIG. 14). O-rings or like seals 69 prevent by-pass of water along the length of shuttle valve 66. One example of a suitable cain surface 64 used to adjust lateral movement of shuttle valve 66 is outlined in FIG. 16. The cam surface 64 is formed in the interior of the rotatable portion 62 of housing 12 (see FIG. 12 ).

Thus, by a simple twist of the upper housing 62 it is possible to turn the water flow through the showerhead on or off without altering the spray patterns or intensity. This is unlike other showerheads where the shutoff is in the pipes leading to the showerhead or is accomplished by turning a handle on the side of a showerhead. In the latter embodiments, the handle is usually linked to the spray pattern thereby requiring readjustment of the spray pattern every time the water flow is turned off to soap-up or shampoo. That inconvenience is avoided with applicant's approach.

The showerhead embodiment illustrated in FIGS. 9–15 contains dual shower patterns; the adjustable spray pattern around the periphery of the faceplate and a central vibrating spray. Selection of the desired spray pattern is accomplished using handle 14. As previously described, rotation of handle 14 may be translated into vertical movement of tubular sleeve 36 via off-center pin 34.

In this embodiment tubular sleeve 36 surrounds a diverter 50 which is fastened to the interior showerhead housing 72 by screw threads 51 or other attachment means. The upper portion 52 of diverter 50 has an opening therein which is in fluid connection with the water outlet port 76. When shuttle valve 66 is translated into an open position using the rotatable portion 62 of the showerhead body 12, water flows into the diverter through opening 52.

Water exits diverter 52 through one or more outlets 54 in the side thereof. The path taken by water exiting the diverter 52 is determined by the vertical position of the tubular sleeve 36 relative to diverter 50. When the sleeve 36 holding the plungers 20 is at is uppermost position (FIG. 14) via rotation of handle 14, the inner portion of sleeve 36 engages an upper O-ring 55 arranged on diverter 52. An enlarged bore 38 in the lower half of sleeve 36 is then located above lower O-ring 56 arranged on diverter 52. This permits passage of water through the center of enlarged bore 38 to the vibrating shower 90 described in more detail below.

When the sleeve 36 is lowered by counter rotation of handle 14 (FIGS. 12–14) the passage of water to the vibrating spray head 90 is blocked by the mating fit between the smaller bore 39 on the interior of sleeve 36 and lower O-ring 56 on diverter 50. The water then flows from diverter outlets 54 into the space 35 between the exterior of sleeve 36 and interior housing 72 to the openings 40 in faceplate 16. Thus, by simple rotation of handle 14 it is possible for a user of applicants' showerhead to select between a regular spray and vibratory spray patterns.

The enlarged lower bore 38 of sleeve 36 is held in position within showerhead 10 by a post 17 formed in faceplate 16. An O-ring positioned in slot 18 of post 17 seals against backflow of water into the vibrating shower 90 when the main flow of water is to openings 40 in faceplate 16. The post 17 also coacts with diverter 50 to form guides for movement of sleeve 36.

Faceplate 16 contains a central opening 19 immediately below post 17 which forms the chamber in which applicants' vibratory spray head 90 is placed. A vibratory spray pattern is generated by the careful placement and orientation of plates 92, 94 in this opening 18. As illustrated in FIGS. 12–14 and 17 upper plate 92 contains holes 93 at the center and about the periphery thereof. This plate 92 also contains upstanding dams 91 about its periphery that help guide water to holes 93 and space those holes from the lateral underside of post 17. Lower plate 94 preferably contains a matching set of holes 95 of slightly larger diameter in the same configuration as the upper plate. The ratio of hole diameter in lower plate 94 to hole diameter in upper plate 92 is preferably about 2:1, for example a 1/16 inch diameter hole in upper plate 92 and 1/8 inch diameter hole in lower plate 94. The number and orientation of holes in each plate can be varied but that number and orientation should be substantially the same in both the upper 92 and lower 94 plates.

To obtain a good vibratory spray, it is also desirable to have the mating patterns of holes in the upper and lower plates 92, 94 vertically aligned when the plates are assembled in the faceplate as shown in FIGS. 11–14. The best vibratory spray pattern is achieved when the holes in the upper plate 92 are aligned directly above the center of the larger holes in the lower plate 94. The quality of the vibratory spray pattern deteriorates in direct proportion to misalignment of the holes in the respective plates. When the holes 93, 95 in upper and lower plates 92, 94, respectively, start to misalign with each other, the vibrating spray pattern starts to deteriorate.

Another factor affecting the vibratory spray emanating from spray head 90 is the separation between the upper and lower plates 92, 94. Using upper and lower holes 93, 95 of 1/16 and 1/8 inch diameter, respectively, applicants have found a plate separation of about two tenths of an inch (0.200) to be optimal with a preferred range of about 0.150 to 0.300 inch and an operable range of 0.100 to 0.400 inch. If the holes in the upper and lower plates 92, 94 are enlarged, this plate separation could be increased. A general ratio of plate separation to diameter of the hole in the lower plate of about 2:1 is preferred. It appears that the vibratory spray pattern is a function of the angle of expansion of the spray exiting each hole 93 in up per plate 92. This angle of expansion will determine the distance between the upper 92 and lower 94 plates.

As just described, applicants' vibratory spray head 90 emits a well defined vibratory spray pattern that can be used in a showerhead, or as a separate water discharge device, for example, at the end of a flexible hose. So used, the pulsating vibratory stream materially aids in cleansing of articles ranging from cars to humans. Use in a hand-held showering device would materially improve personal hygiene.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

We claim:

1. A fluid flow control valve, comprising:

a valve body with at least one fluid inlet and outlet therein;

a movable valve member slidable in a mating bore in the valve body, at least a portion of the valve member having dimensions allowing passage of fluid through the valve body;

a shutoff mechanism arranged on an exterior portion of the valve body; and a cam surface associated with the shutoff mechanism for engagement with both ends of the movable valve member whereby movement of the shutoff mechanism causes the valve member to move within the valve body to control passage of fluid through the fluid flow control valve.

2. The fluid control valve of claim 1 wherein the movable valve member is an elongated cylindrical bobbin having a portion thereof of reduced diameter.

3. The fluid control valve of claim 2 wherein flow control rings are arranged on each end of the reduced diameter portion of the movable valve member to limit fluid flow outside the reduced diameter portion of the movable valve member.

4. The fluid control valve of claim 3 wherein the flow control rings sealingly, but slidably, engage the inner surface of the bore in the valve body.

5. The fluid control valve of claim 3 wherein the reduced diameter portion of the movable valve member lying between the flow control rings is laterally moved within the mating bore of the valve body by rotational movement of the shutoff mechanism to control passage of fluid through the fluid control valve.

6. The fluid control valve of claim 5 wherein about a 90° rotation of the shutoff mechanism results in sufficient lateral movement of the movable valve member to substantially halt passage of fluid through the fluid control valve.

7. The fluid control valve of claim 1 wherein the rotating shutoff mechanism includes the cam surface on the interior portion thereof.

8. The fluid control valve of claim 7 wherein the shutoff mechanism surrounds the cam surface.

9. A showerhead containing the flow control valve of claim 1.

10. The showerhead of claim 9, further comprising:

a pulsating fluid discharge device having a fluid containment passage, a fluid source under pressure connected at one end of the passage and substantially parallel plates at the other end of the passage, the plate closest to the fluid source having at least one bore therein substantially aligned with at least a like number of bores in the parallel plate furthest from the fluid source.

11. The showerhead of claim 10 wherein the parallel plates are spaced from each other by a distance about twice the diameter of the hole in the plate furthest from the source.

12. The showerhead of claim 10 wherein the diameter of the holes in the plate closest to the fluid source is about one-half the diameter of the holes in the plate furthest from the fluid source.

13. The showerhead of claim 10 wherein substantially all the holes in the plate closest to the fluid source are aligned with the holes in the plate furthest from the fluid source.

14. A showerhead comprising:

an outer housing;

a fluid inlet at one end of the housing; and at least one fluid passage through the housing fluidly connecting the fluid inlet with at least one of a plurality of openings in a faceplate at the other end of the housing, the openings in the faceplate having a pattern of grooves therein which substantially eliminate intersection of fluid streams passing though such openings after they exit the showerhead.

15. The showerhead of claim 14 wherein the pattern of grooves in the openings are concentrically arranged in each of the openings of the faceplate.

16. The showerhead of claim 14 wherein at least one of the grooves in the faceplate opening is oriented to face the geometric center of the faceplate.

17. The showerhead of claim 16 wherein multiple grooves are placed around the faceplate opening with at least a majority of the grooves being located on the semicircular half of the opening facing away from the geometric center of the faceplate.

18. The showerhead of claim 16 wherein the grove facing the center of the faceplate is separated from the other grooves by a radial distance at least twice the radial distance between other grooves in the faceplate opening.

19. The showerhead of claim 14 wherein flexibly skirted plungers are arranged within the faceplate openings.

20. The showerhead of claim 19 wherein a handle is rotatably mounted on the outer surface of the housing and linked to the plungers wherein rotation of the handle cause linear movement of the plungers within the faceplate openings.

21. The showerhead of claim 19 wherein the internal surface of about half the grooves in the opening of the faceplate are substantially parallel to those openings at their upper end and angled away from the openings at their lower end.

22. The showerhead of claim 21, wherein movement of the skirted plungers along the interior surface of the openings changes the spray pattern from columnar to cone shaped.

23. The showerhead of claim 20 wherein tabs are located on one end of the plungers whereby the plungers may be rotated within the openings in the faceplate.

24. The showerhead of claim 20, wherein one end of the flexibly skirted plunger is dimensionally larger than the faceplate opening whereby vertical movement of the plunger wipes the faceplate openings.

* * * * *